US005315054A

United States Patent [19]

Teel

[11] Patent Number: 5,315,054

[45] Date of Patent: May 24, 1994

[54] LIQUID FUEL SOLUTIONS OF METHANE AND LIQUID HYDROCARBONS

[75] Inventor: Dale Teel, Bellingham, Wash.

[73] Assignee: Burnett Oil Co., Inc., Ft. Worth, Tex.

[21] Appl. No.: 594,385

[22] Filed: Oct. 5, 1990

[51] Int. Cl.[5] ..... C10L 1/04; C10L 3/12; C09K 5/00

[52] U.S. Cl. ..... 585/14; 48/127.3; 48/197 FM

[58] Field of Search ..... 44/300; 585/14; 48/197 FM, 127.3; 62/9, 36, 50.1

[56] References Cited

U.S. PATENT DOCUMENTS

| | | | |
|---|---|---|---|
| 1,429,175 | 9/1922 | Thompson | 585/14 |
| 2,449,118 | 9/1948 | Holicer | 62/1 |
| 2,513,770 | 7/1950 | White | 44/448 |
| 2,535,148 | 12/1950 | Martin et al. | 48/190 |
| 3,232,725 | 2/1966 | Secord et al. | 48/190 |
| 3,514,274 | 5/1970 | Chan et al. | 48/190 |
| 3,771,260 | 11/1973 | Arenson | 48/127.3 |
| 3,990,256 | 11/1976 | May et al. | 48/127.3 |
| 4,045,189 | 8/1977 | Brum et al. | 48/197 FM |

FOREIGN PATENT DOCUMENTS

| | | |
|---|---|---|
| 2046805 | 3/1972 | Fed. Rep. of Germany . |
| 2438194 | 8/1974 | Fed. Rep. of Germany . |
| 0138685 | 11/1984 | Japan . |
| 61-197897 | 2/1986 | Japan . |

*Primary Examiner*—Margaret Medley
*Attorney, Agent, or Firm*—Hubbard, Tucker & Harris

[57] ABSTRACT

Liquid hydrocarbons are capable of forming solutions of methane which is substantially soluble for example in liquefied petroleum gas creating a potential for the production of liquid fuel solutions of methane and liquefied petroleum for storage, industrial use and vehicular fuel. A binary mixture of hydrocarbons, comprised of methane dissolved in propane or butane is presented which enhance the amount of methane soluble in propane and butane thereby providing a product and methodology for establishing natural gas as an alternative fuel. A binary liquid fuel solution of methane is provided by directly mixing a liquefied petroleum gas into liquefied natural gas thereby cooling the liquefied petroleum gas in order to dissolve an enhanced amount of methane into the liquid by contacting the cooled liquefied petroleum gas/liquefied natural gas liquid blend with dried pipeline natural gas or other sources of natural gas. Storage and reaction vessels are presented which are capable of storing liquefied natural gas and serving as a mixing vessel and shipping vessel for the resulting binary liquid fuel comprised of methane dissolved in liquid hydrocarbons.

19 Claims, 1 Drawing Sheet

LIQUID FUEL SOLUTIONS OF METHANE AND LIQUID HYDROCARBONS

FIELD OF THE INVENTION

The invention relates to liquid fuel solutions of methane and liquid hydrocarbons and a process for incorporating substantial amounts of methane into liquid phase for storage, use as vehicular fuel and the like In another aspect, the invention relates to a method and product which offers an opportunity to allow more efficient economical and environmentally acceptable utilization of natural gas inclusive of storage, transportation and utilization through the formation of solutions wherein the methane is dissolved in liquid hydrocarbons In yet another aspect, the invention relates to a product and methodology which provides a route for establishing natural gas as an alternate fuel without incorporating the present obstacles of compressed natural gas and liquefied natural gas.

Transportation fuel use has been almost exclusively dominated by gasoline and diesel powered vehicles i.e., use of liquid fuel. The natural gas industry has made numerous efforts to address this potential market. Dual fuel systems have been proposed and used whereby a compressed natural gas system is added to a conventional gasoline vehicle with the vehicle being capable of operation on either gasoline or natural gas. Interest in natural gas fueled vehicles has continued to grow with the economics of cost and availability of gasoline and diesel liquid fuels being somewhat unpredictable. In addition, a motivating force for natural gas fueled vehicles has been to clean up air pollution which is threatening air quality in many metropolitan areas. Clean air legislation and regulations are creating a demand for alternative vehicle fuels throughout various areas of the world. The primary alternative fuels competing for a share of the vehicular market are methanol/ethanol, reformulated gasoline, clean diesel, compressed natural gas and liquefied natural gas. Natural gas based alternative fuels have environmental advantages over the competing fuels However, significant obstacles remain to be overcome including the challenge of establishing infrastructure for convenient fuel delivery and energy density of proposed fuels These obstacles can be met by providing a technique and a product which incorporates methane into liquid phase fuel for general purpose use but more specifically for vehicular fuel without the cost of liquefaction of the methane to liquefied natural gas.

BACKGROUND OF THE INVENTION

Studies have shown that gaseous methane can be stored in liquid hydrocarbons for example propane through solute absorption into solution. Propane is cooled down with refrigeration equipment and a condensor coil while the methane is introduced into the propane by means of gas jets. This process is accomplished by considerable increase in pressure. When the pressure is relieved, the methane is flashed out of the mixture as a gas and can be used as a fuel gas. After the methane is utilized the propane then can be vaporized and used also as gas for general fuel requirements. Storage of natural gas by solution under pressure in refrigerated liquefied petroleum gas has been presented as an idea for combining conventional pressure storage tanks and liquefied petroleum-air plant combinations in one system at the same time increasing the storage capacity up to 5 to 6 times for the same volume and pressure. The high solubility of natural gas in liquefied petroleum gas has been used as a storage tool to meet increased consumption requirements and demands on existing storage volume equipment. These studies were primarily directed toward peak-shaving operations wherein the alternative was liquefied natural gas storage However, in these storage applications the end product was desired to be utilized as a gas fuel form for stationary industrial or pipeline utilization.

Vehicular utilization of natural gas continues to be frustrated by the need of service and refueling infrastructures because of continued focus on compressed natural gas utilization. Even though natural gas is a logical and common sense substitute for gasoline, the use of natural gas as compressed natural gas for vehicles has not been well received. The primary problem with the use of compressed natural gas is the weight, bulk and cost of pressure vessels. Limited mileage range and significant weight and space requirements of such compressed natural gas tanks generally limits the use of compressed natural gas to large vehicles such as buses and/or trucks. But even with the larger vehicles, the limited use, range and limited supply distribution systems has stagnated vehicular use of methane.

Utilization of the solubility of methane in for example, liquefied petroleum gas such as propane and butane has been expanded to include processes wherein liquefied natural gas is vaporized through heat exchange with liquid propane and then pipeline gas (methane) is dissolved in the propane, the liquid mixture then being vaporized for utilization. The procedure exploits the extreme cold of liquefied natural gas to cool down the propane by heat exchange, it being recognized that the cooling process is necessary as the solubility of methane and liquid propane increases with the decrease in temperature However, the prior art as represented by West German Offenlegungsschrift 243,819 disclosed Feb. 19, 1976 addresses the preparation of a methane liquid propane solution for the purposes of storage and transportation. The reference further allows that it is possible to mix air or nitrogen into the blended and vaporized propane with the gas air mixture being adjusted for end use as a propane substitute. The procedure is proposed as a solution wherein a limited quantity of propane in the form of liquid is available.

The forming of solutions of methane and liquefied petroleum gas to form a liquid for storage or transportation for later use as a gas fuel does not address the problems of using natural gas as an alternative fuel for gasoline for vehicular purposes. The utilization of refrigerated liquid fuels which incorporate substantial amounts of methane can provide all the known benefits of natural gas vehicles such as low polution emission and displacement of imported oil while minimizing institutional and economic barriers associated with these vehicles, by use of the liquid fuel solutions of methane as a liquid at the point of use. The liquid fuel solutions of methane and liquefied petroleum gas provides a technique to place methane in a liquid fuel for vehicle fuel usage without the full cost of liquefied natural gas liquefaction. Liquid fuel solutions are suitable for use in existing propane and butane infrastructure for delivery, storage and distribution.

SUMMARY OF THE INVENTION $C_1$14 $C_4$ liquid hydrocarbons are capable of forming solutions. For example, liquid methane at −165° C. is completely soluble in liquid propane at −165° C. A binary mixture of the hydrocarbons, methane and propane or butane (hereinafter referred to and defined as "Prothane" TM or "Buthane" TM) are proposed which enhance the amount of methane which can be dissolved in propane and butane thus providing a newly conceived fuel substitute for gasoline or liquefied petroleum gas. Mixing propane directly into liquefied natural gas and evaporating part of the liquefied natural gas provides cooling of the propane and enhances the amount of methane that can be dissolved in the chilled propane. Dissolving of significant amounts of pipeline gas (methane) into the cold propane is achievable. The economics of attempting to superchill propane by mechanical refrigeration to a temperature low enough to dissolve the desired maximum amount of methane is unattractive. However, chilling of the propane by mixing directly into liquefied natural gas and evaporating a portion of the liquefied natural gas permits such chilling to be achieved with a minimum of investment and apparatus. The Prothane or Buthane provides a new binary liquid fuel having an energy density (calories per unit of container interior volume) which provides a practical alternative to liquefied petroleum gas or liquefied natural gas. It is conceived that Prothane or Buthane could be a fuel substitute for gasoline or liquefied petroleum gas. The most significant aspect of Prothane is that it provides a process and product for presenting substantial amounts of methane in liquid phase for storage, transportation and use as a vehicular fuel. Prothane offers an opportunity to allow more efficient, economical and environmentally acceptable utilization of natural gas.

The apparatus according to the invention, would be provided for transportation or storage vessels for Prothane wherein the vessel contains spargers for mixing propane into liquefied natural gas followed by mixing pipeline gas into the chilled propane. These vessels would also be equipped with temperature sensors such as thermal couples and pressure monitors in order to aid control of the mixing processes. In addition, the vessels provide external use of the vapor from the liquefied natural gas evaporation for prechilling propane and/or pipeline gas before introduction into the vessel. The prechilling can be done by indirect heat exchange or a direct fluid mixing. The storage and mixing vessels could be a dual use vessel such as refrigerated pressurized tank car or tanker truck wherein the vessel is utilized for preparing the Prothane or Buthane and for shipping to the point of use. The vessels will be equipped for liquid extraction therefrom, avoiding a methane flash or a fuel takeoff which is rich in methane. The liquid extraction will provide in general a liquid fuel solution of a predetermined methane/propane or butane consistency.

BRIEF DESCRIPTION OF THE DRAWINGS

Features which are believed to characterize the invention are set forth in the appended claims. The invention itself together with its features, objects and intended advantages will be best understood by reference to the following detailed description of a presently preferred embodiment thereof taken in conjunction with the accompanying drawings in which:

DETAILED DESCRIPTION

The Prothane or Buthane in accordance with the invention can be made by mixing for example, propane with liquefied natural gas and allowing the liquefied natural gas to evaporate, with heat exchange from this vapor with the propane and pipeline natural gas. The resulting Prothane composition will be approximately 70% methane and 30% propane. However, various other lesser amounts of methane can be utilized if the propane is chilled to a lesser degree which would afford less than maximum solution of the methane. Prothane as a liquid fuel solution of methane and propane will provide a pathway which will permit pipeline methane from natural gas to displace gasoline and LPG vehicular fuels or fuels for other purposes. The Prothane of the 70% methane and 30% propane composition will be comprised of about 20% gas from liquefied natural gas and about 30% propane with the remaining 50% by volume being comprised of pipeline natural gas dissolved in propane. Prothane will expand the effectiveness of the relatively expensive liquefied natural gas by several factors for example one gallon of liquefied natural gas will make five gallons of Prothane. Since Prothane will be at a substantially higher temperature than liquefied natural gas, Prothane should resolve in part the problem of tank venting due to boil off and the hazard of cryogenic burns which have been experienced by users of liquefied natural gas.

Prothane as a liquid fuel can be stored, transported and handled in general very similar to methodologies utilized for LPG delivery systems and refilling stations already established. Such a parallel system advantage of Prothane overcomes a major problem faced by other alternative fuels. Presently, in the United States, about 25,000 retail propane outlets with more than nine billion gallons storage capacity exists. Several million vehicles worldwide operate on propane. Prothane containing approximately 30% propane would help vehicle performance because of its faster combustion rates as compared to compressed natural gas fuel.

Figure 1:
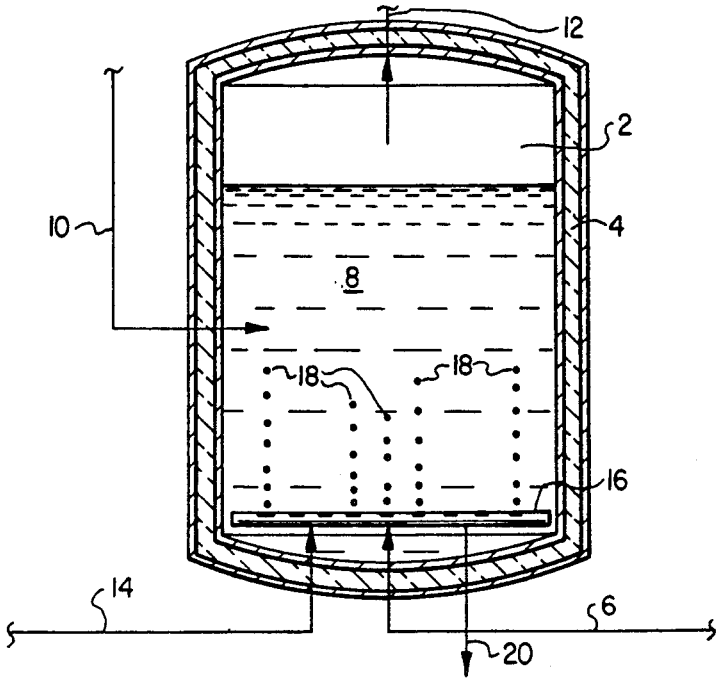
FIG. 1 is a schematic diagram illustrating one possible version of a mixing and storage vessel according to the invention.

The schematic diagram of FIG. 1 provides in part, a version of an apparatus which according to the invention, would be suitable for producing Prothane or Buthane. The apparatus as presented in the diagram of FIG. 1 provides for conducting the procedure in accordance with the invention essentially consisting of an insulated pressure mixing vessel 2 for admixing under controlled conditions liquid propane into direct contact with liquefied natural gas. Mixing vessel 2 has insulation 4. Liquid propane, prechilled in a preferred embodiment, reaches the vessel 2 through liquid propane conduit 6. Liquefied natural gas is indicated within the vessel 2 as liquid level 8. Liquefied natural gas conduit 10 provides a source of liquefied natural gas for the procedure according to the invention wherein the liquefied natural gas is placed in the insulated pressure mixing vessel before the liquid propane and pipeline natural gas is introduced after the propane has been chilled to about −120° C. by evaporating part of the liquefied natural gas. A vaporized natural gas conduit 12 removes a portion of the liquefied natural gas which is vaporized upon the introduction of liquid propane and dry pipeline natural gas. The dry pipeline natural gas introduced through conduit 14 is introduced after the introduction of the liquefied propane through a multiple port sparger 16. Liquid propane and/or dry natural gas is introduced into the liquefied natural gas as indicated by bubbles or droplets 18. The apparatus according to the invention, utilizes the insulated pressure mixing vessel 2 in a batch to batch operation mode wherein after the mixing has been completed, the Prothane or Buthane liquid fuel solution containing substantial amounts of methane is removed as a liquid through conduit 20.

Not shown in FIG. 1 are control mechanisms for controlling the batch mixing of Prothane or Buthane such as thermal couples, pressure gauges and the like. The production of liquid fuel solution of methane and propane or butane is achieved though pressure control wherein the propane introduction into the liquefied natural gas is temperature and pressure regulated and controlled. For example, when a specific temperature and pressure are reached in the reaction vessel 2 the propane supply is cut off through remote control valve means which are not shown in FIG. 1. In addition, the vaporized natural gas flowing through conduit 12 from the vessel 2 is utilized for prechilling of the liquid propane either directly or indirectly and/or prechilling of the dried pipeline natural gas. Another option not shown in FIG. 1 is the utilization of the vaporized natural gas flowing through conduit 12 for return to the liquefied natural gas plant or fuel use.

Figure 2:
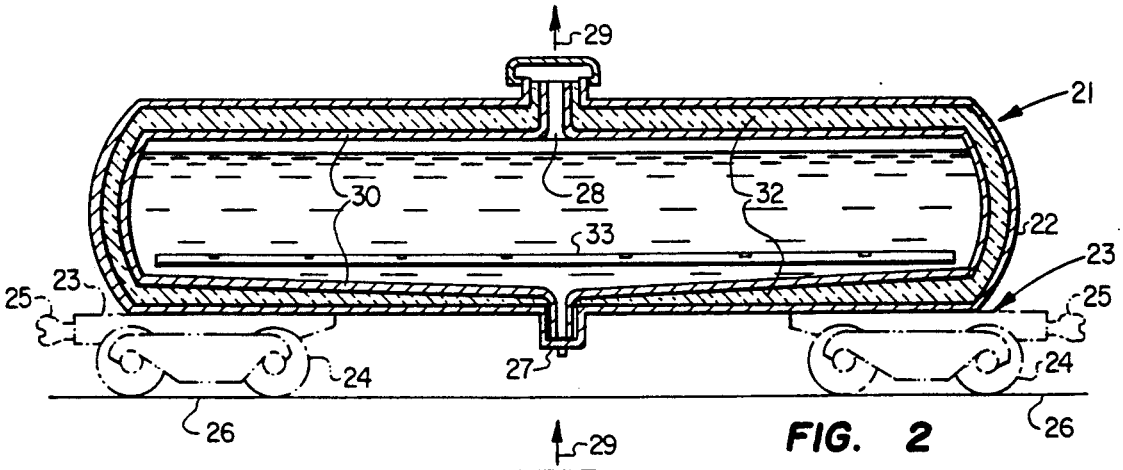
FIG. 2 shows a longitudinal sectional view of a typical insulated railway tank car with Prothane or Buthane outlet conduit, vapor outlet conduit and a multiport sparger located within the inner tank.
Figure 3:
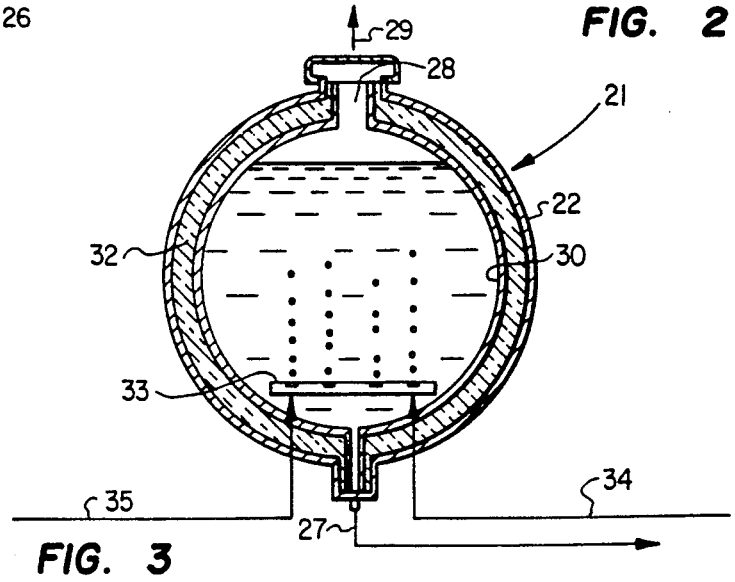
FIG. 3 is a cross section of the insulated pressure mixing vessel (railway tank car) of FIG. 2 which illustrates various conduit connections when the tank car is used as a mixing vessel.

In FIG. 2, a longitudinal sectional view of a typical insulated railway tank car is presented wherein the insulated pressure mixing vessel of the tank car can be used for storage, shipping or mixing of the Prothane or Buthane. A railway tank car of conventional insulated pressure vessel design is generally illustrated by reference numeral 21. The railway tank car 21 includes an outer shell 22, supported by running gear 23 at both ends, which running gear 23 is further characterized by wheels 24 resting on rail 26 and containing couplers 25. A liquid fuel solution of Prothane or Buthane outlet conduit 27 is provided in the bottom of the tank car 21 as a means for providing liquid fuel for storage or use. A vapor zone 28 is located in the upper portion of the tank car specifically the dome region with a vapor outlet conduit 29 being available for pop off and/or recycling of vapor produced by the mixing process The inner vessel wall 30 is spaced apart and separated from the outer shell 22 by insulation 32. For purposes of using the tank car as a mixing vessel, a multiple port sparger means 33 is provided for introducing liquid propane from the liquid propane conduit 34 as shown in FIG. 3. In FIG. 3, dry pipeline natural gas conduit 35 is also communicatively connected with the multiple port sparger means 33 for introducing dry pipeline natural gas into the liquid mix of propane and liquefied natural gas for absorption. The original liquefied natural gas liquid level 38 is slowly converted from liquefied natural gas to Prothane by the controlled mixing of (1) liquid propane and (2) dry pipeline natural gas through the multiple port sparger means 33 as indicated by rising bubbles or droplets 36 of liquid propane or dry natural gas.

FIGS. 2 and 3 are specifically directed toward use of insulated pressure mixing vessels comprised of a special railway tank car. Such a vessel (smaller) could be mounted on a truck or a truck trailer combination. The insulated pressure mixing vessel could be very suitably utilized as a truck trailer having multiple port sparger means as well as the thermal couples and pressure means for controlling the mixing and maximum propane introduction to the vessel through pressure valve shut-off. In fact, such a vessel could be used on ocean going ships or coastal barges which are specifically designed for insulation and pressure vessel considerations. Liquefied natural gas shipping and similar transportation means can be used for transportation and mixing for worldwide distribution of Prothane and Buthane.

The invention claims that a new binary liquid fuel such as methane dissolved in cold propane or cold butane would provide energy density (calories per unit of container interior volume) which would be a practical alternative to either liquefied petroleum gas, liquefied natural gas or gasoline. The Prothane or Buthane is drawn off as a liquid and vaporized for combustion under controlled conditions. One of the objectives of the invention was to minimize the use of the more expensive fuels, liquefied natural gas, and propane and butane, in order to maximize the use of the least expensive fuel, pipeline natural gas.

The method according to the invention provides for a batch blending or mixing of liquefied natural gas and propane or butane with pipeline natural gas. A certain quantity of liquefied natural gas is placed in an insulated double walled pressure storage mixing vessel. Propane or butane is inserted into the liquefied natural gas under controlled conditions followed by the insertion of dried pipeline natural gas into the chilled propane or butane. The method uses the heat absorbed by vaporizing the liquefied natural gas to cool the propane or butane and then in turn to cool the pipeline natural gas. Vaporized liquefied natural gas can be used for prechilling the propane or butane as well as the pipeline natural gas. The method according to the invention is concerned with maximizing the amount of pipeline natural gas that can be dissolved into Prothane and Buthane while minimizing use of the liquefied natural gas.

Prothane and Buthane are newly conceived fuel substitutes for gasoline, liquefied petroleum gas, and liquefied natural gas. By dissolving substantial quantities of the lesser expensive pipeline natural gas (methane) into propane or butane which has been chilled by direct heat exchange with liquefied natural gas an efficient and environmentally safe fuel is provided at a minimum use of more expensive fuel such as liquefied natural gas and propane or butane. The concept of Prothane or Buthane addresses a worldwide need for displacing gasoline or diesel by innovative natural gas alternative. Major efforts are underway to develop new engine technology, alternative transportation technology, and other related fields to mitigate the growing atmospheric pollution caused by automobiles. A significant need exists for the Prothane and Buthane technology that takes advantage of natural gas reserves while providing a cost-effective and energy efficient alternative to the end user sector.

Prothane provides a pathway for storing and utilizing a liquid mixture of methane dissolved is propane which is a newly conceived fuel substitute for motor vehicles. Prothane can be maintained at temperatures in a range of about −100° C. to about −80° C. in an insulated tank similar to the common household liquefied petroleum gas tank with insulation modifications. The Prothane can be kept in reinforced liquefied petroleum gas containers built to operate at up to 300 psig. Prothane will be competitive with compressed natural gas as an automobile fuel. The utilization of Prothane as a liquid will provide greater fuel capacity per volume of fuel tank utilization per vehicle. In addition, Prothane takes advantage of the liquid propane delivery system already established in the world and could start displacing gasoline with a clean burning alternative domestic fuel, immediately.

An obvious benefit of Prothane is that it provides an early entry into displacing gasoline with natural gas liquid formed fuel. The traditional barriers of natural gas fueled vehicles have been low driving range and the need for bulky and heavy tanks. These objections can be met by Prothane which will be significantly improved by the high energy density fuel in liquid form which can be stored and carried in an insulated liquefied petroleum tank. In addition, Prothane can be produced in rail cars or tanker trucks as well as on site production and stationary reaction vessels. The additional need for construction of expensive infrastructure is also minimized. Prothane can be produced at existing liquefied petroleum or liquefied natural gas production facilities with access to pipeline natural gas and can be delivered for refills in a similar fashion as liquefied petroleum gas service stations. In addition, propane and liquefied natural gas can be shipped to natural gas sources not connected to pipelines, for on-site production into rail cars and then forwarded to consumer service points. Prothane will provide all of the known benefits of natural gas fueled vehicles such as pollution emissions and the like while minimizing institutional and economic barriers associated with natural gas fueled vehicles. The mixture of 60% to 70% methane and 40% to 30% propane as a high density fuel alternative will allow industry and the end user for the first time, a potentially affordable substitute for gasoline.

Fuel variability during the discharge process of a binary mixture such as Prothane or Buthane will be minimized by withdrawing the fuel from the supply tank in liquid form and vaporizing for use in the vehicle or other fuel consuming utilizations. The Prothane or Buthane will be drawn off as a liquid from the tank and carbureted or injected as a vapor into the internal combustion engines. Since the fuel will be generally withdrawn in the liquid form, the fuel mixture ratio between methane and propane will not significantly change from when the tank is full or when the tank is near empty. On the other hand, if the fuel is taken off as a vapor, the fuel mixture ratio between methane and propane will vary more significantly as the tank is depleted of Prothane.

Research has indicated that as much as 77% methane can be absorbed or dissolved in propane at −100° C. and at 300 psig. The solubility of methane and propane is indicated in Table I below wherein at various temperatures, the amount of methane dissolved in propane is indicated, the pressure being sufficient to maintain Prothane in the liquid state.

TABLE 1

| °F. | °C. | Methane | Propane |
|---|---|---|---|
| 68 | 20 | 6% | 94% |
| −26 | −31 | 17% | 83% |
| −92 | −78 | 42% | 58% |
| −148 | −100 | 77% | 23% |

TABLE 1-continued

| °F. | °C. | Methane | Propane |
|---|---|---|---|
| −260 | −162 | 100% | (LNG) — |

In the above scenario (Table I), dissolving methane in propane or butane, Prothane or Buthane, would provide twice the energy density in a given interior volume of a container as compared to compressed natural gas assuming a 50—50 weight mix. The weight penalty of a 3,000 psig compressed natural gas container is avoided. The Prothane container has a larger volume outside than inside because of a dual wall insulation construction. However, very little weight penalty is experienced as compared to gasoline or diesel.

The following assumptions and data were utilized to prepare calculated studies of various Prothane, Buthane blends:

Assumptions

Liquefied Natural Gas LNG is available at zero pressure at 112° K. (−165° C.).

Liquefied Petroleum Gas LPG is available at 233° K. (−42° C.) at zero pressure.

Liquid Butane is available at 272° K. (−5° C.) at zero pressure.

Compressed Natural Gas CNG is available at 293° K. (20° C.) at 500 psig.

Data NG (a) Densities
Liquefied Natural Gas LNG
122° K. 423 gr/liter
157° K. 335 gr/liter
289° K. 260 gr/liter (apparent value)
critical condition
191° K. - 46 ATM
Natural Gas NG
293° K. - 0.7 gr/liter
293° K. - 500 psig - 23.8 gr/liter
(b) Heat of vaporizaton 123.87 cal/gm at 112° K.
Specific heat
at 298° K. 0.532 cal/gm/°C.
at 200° K. 0.5 (Ref pg 812, Myers)
at 100° K. 0.496

Data Propane - Butane (a)
Density Propane
240° K. (−33° C.) 568 gr/liter
200° K. (−73° C.) 611 gr/liter
critical conditions 370° K. (97° C.); 42.3 ATM
Density Butane
230° K. (−43° C.) 643 gr/liter
170° K. (−103° C.) 700 gr/liter
critical condition 425° K. (152° C.) - 38 ATM
(b) Specific Heats
Propane gas 0.398 cal/gm/°C.
Propane liquid 0.60 cal/gm/°C.
Butane gas 0.396 cal/gm/°C.
Butane liquid 0.57 cal/gm/°C.
For liquids, Cp is almost independent of pressure Concept and Method Insert some quantity of LNG (liquefied natural gas) into an insulated (double wall) storage tank. Assume that no heat enters the tank during its use. Second, insert some quantity of propane into that same tank. Third, pressurize the tank with dry pipeline gas. Alternatively, substitute butane for propane.

Use the heat absorbed by vaporizing LNG and raising its temperature to cool the liquid propane or butane and the pipeline gas.

In these calculations, various combinations were examined to maximize pipeline gas content and to minimize LNG content.

EXAMPLE 1

Store in vessel at 500 psi—at the pressure of the CNG (pipeline gas) supply.

Storage conditions—194° K. (−69° C.) 500 psi
0.7 Mol methane; 0.3 Mol propane
by weight: methane/propane
45.9% methane/54.1% propane
while gas above liquid is almost pure methane (99%)
(a) Volumetric makeup of mixture in tank liquid
173/423=0.41 liters LNG
286/0.7=408 liters NG (at normal temperature and pressure)
541/611=0.88 liters LPG

EXAMPLE 2

Store in vessel at 300 psi at 174° K. (−99° C.)—lower temperature, lower pressure than Example 1.

Storage condition—174° K.—300 psi
0.769 Mol methane: 0.231 Mol propane
by weight: methane/propane
54.8% methane; 45.2% propane
Example 2 has lowered propane content.
(a) Volumetric makeup of mixture
240/423=0.55 liters LNG (more LNG than Example 1)
308.7=447 liters NG (at normal temperature and pressure) (more CNG than Concept 1)
452/611=0.73 liters LPG (less LPG than Example 1)
(b) NG in mixture is 57% CNG; 43% LNG
Example 2 has increased the fraction of NG that comes from LNG.

EXAMPLE 3

Allow the CNG to do work in expanding from 500 psi to 300 psi.

Store in vessel as in Example 2 at 300 psi at 174° K. (−99° C.)

Storage conditions—0.769 Mol methane; 0.231 Mol propane
Solution as in Example 2, but now heat to be removed from CNG is less and therefore the amount of LNG required will be lower.
(a) Volumetric makeup of mixture
208/423=0.49 liters LNG (less LNG than Example 2)
340/0.7=485 liters NG (at NTP) (more CNG than Example 2)
452/611 =0.73 liters LPG
(b) NG in mixture is 62% CNG; 38% LNG
Example 3 has lowered the fraction of NG that comes from LNG.

EXAMPLE 4

Store in vessel at 250 psi at 166° K. (−107° C.) at 250 psi, a mixture of NG and butane.

Storage condition 275 psi
0.89 Mol methane; 0.11 Mol butane by weight; methane/propane 69% methane/31% butane Example 4 substitutes butane for propane and stores mixture at a lower temperature than previous concepts (only 8° C. lower) and at slightly lower pressure. More of the mixture is methane than in any previous analysis.

(a) Volumetric makeup of mixture
302/423=0.714 liters LNG
388/0.7=554 liters CNG (at normal temperature and pressure)
(more NG than any other concept)
310/700=0.44 liters butane
(b) Natural gas in the mixture is 56% CNG; 44% LNG
This is essentially the same ratio as in Example 2, but in this case more NG would be stored in mixture.
0.69/0.548 - 1.26 - 26% more NG

EXAMPLE 5 a) Initial conditions
propane at 10° C.; CNG at 20° C.
at 500 psi; LNG at −165° C.
b) Store in vessel at 500 psi
liquid composition, at −194° K. (−69° C.)
0.7 Mol methane; 0.3 Mol propane by weight: methane/propane 45.9% methane/54.1% propane
gas above liquid is pure methane (99%)
c) Cooling energy from LNG
123.87 cal/gr+0.45(194−112)=160.77 cal/gr
d) Heat to be removed from CNG
0.5(300−194)=53 cal/gr
e) Heat to be removed from propane
0.6(283−194)=53.4 cal/gr
f) Fraction of a gram for each constituent x(LNG), y(CNG)
x+y=0.459
x(160.77)=(0.459−x)53+0.541(53.4)
213.77x=53.21
x=0.248 gr LNG
y=0.541 gr LPG
g) Volumetric makeup of mixture
248/423=0.586 liters LNG
211/0.7=301 liters NG (at normal temperature and pressure)
541/611=0.88 liters LPG
Natural gas in mixture is 45.9% NG and 54.1% LNG, in contrast to 62%.
NG and 38% LNG when the propane was available in a colder state.

EXAMPLE 6 a) Initial conditions as in Example 5
b) Store in vessel at 300 psi at 174° K.(−99° C.)
0.769 Mol methane; 0.231 Mol propane by weight: methane/propane 54.8% methane/45.2% propane
c) Cooling energy from LNG
123.87 cal/gr+0.45(174−112)=151.77 cal/gr
d) Heat to be removed from CNG
0.5(300−174)=63 cal/gr
e) Heat to be removed from propane
0.6(283−174)=65.4 cal/gr
f)
x+y=0.548
x(151.77)=(0.548−x)63+0.452(65.4)
214.77x=64.08
x=0.298 gm LNG
y=0.25 gm CNG
0.452 gm LPG g) Volumetric makeup of mixture 298/423=0.7 liters LNG 250/0.7=357 liters NG (at normal temperature and pressure)

EXAMPLE 7 a) Initial conditions butane at 10° C., CNG at 20° C. at 500 psi; LNG at −165° C.

b) Store in vessel at 275 psi at 166° K.(−107° C.) a mixture of NG and butane 0.89 Mol methane; 0.11 Mol propane by weight: methane/propane 69% methane/31% propane c) Cooling energy from LNG 123.87 cal/gr+0.45(166−112)=148.17 cal/gr d) Heat to be removed from CNG 0.5(300−166)=60.42 cal/gr e) Heat to be removed from butane 0.57(283−166)=66.69 cal/gr f) Fraction of gram for each constituent x(LNG) y(CNG)

x+y=0.69 x(148.17)=(0.69−x)67+0.31(66.69)

215.17x=66.90 x=0.31 gr LNG y=0.38 gr CNG 0.31 gr butane g) Volumetric makeup of mixture

310/423=0.73 liters LNG

380/0.7=542 liters NG (at normal temperature and pressure)

310/700=0.44 liters butane

Natural gas in mixture is 55% NG and 45% LNG.

Since the system studied in Example 4 provided butane only slightly cooler than in this concept. There has been only a small increase in LNG required 45% rather than 44% when butane was slightly cooler.

Prothane is a pathway for expanding the effectiveness of the relatively expensive liquefied natural gas by an approximate factor of 5. One gallon of liquefied natural gas would make 5 gallons of Prothane. Since Prothane is at a substantially higher temperature than liquefied natural gas, the problem of tank venting due to boil off and the hazard of cryogenic burns should be in part resolved by the utilization of Prothane in shipping, storage and use. Prothane is perceived as safer than either CNG (compressed natural gas, 3,000 psig) or liquefied natural gas. The relatively low pressure of 300 psig or less of Prothane compared to CNG and the relatively high temperature of −80° C. to about −100° C. compared with liquefied natural gas at −165° C. clearly indicates that Prothane is a more manageable product. The fuel Prothane would also be associated with propane because of the propane content. Propane has an excellent long term safety record and some tests indicate that vehicles equipped with propane have been found safer in high speed crash tests than their gasoline fueled counterparts. Moreover, propane is nontoxic and any leaks from storage tanks are vaporized and do not contaminate soil or water.

While the preferred embodiments of the invention have been described above, it will be recognized and understood that various modifications may be made therein and the appended claims are intended to cover all such modifications which may fall within the spirit and scope of the invention.

What is claimed is:

1. A method for providing a liquid fuel solution of methane in liquefied petroleum gas comprising:

(a) providing an accumulation of liquefied natural gas in an insulated vessel;

(b) directly mixing a liquefied petroleum gas into the liquefied natural gas contained in said insulated vessel;

(c) vaporizing part of the liquefied natural gas and cooling the liquefied petroleum gas;

(d) adding dried pipeline natural gas to be dissolved in the cooled liquefied petroleum gas; and (e) producing a binary liquid fuel of about 45% to about 75% by volume methane and from about 55% to about 25% by volume of liquefied petroleum gas at a sufficient temperature and pressure to maintain the binary fuel in the liquid state.

2. The method according to claim 1 wherein the binary liquid fuel solution is comprised of about 30% by volume liquefied petroleum gas and 70% by volume methane, the methane content being predominantly from dried pipeline natural gas and the remainder from liquefied natural gas which is present in the vessel before introduction of liquefied petroleum gas and pipeline natural gas.

3. The method according to claim 1 wherein the liquefied petroleum gas is propane and the binary liquid fuel temperature is from about −80° C. to about −120° C. at a pressure of about 230 to 300 psig.

4. The method according to claim 3 wherein the resulting binary liquid fuel solution of methane and propane is comprised of about 30% by volume propane and the methane content is derived from about 20% by volume from liquefied natural gas and about 50% by volume from dried pipeline natural gas.

5. The method according to claim 1 wherein the liquefied petroleum gas is precooled by liquefied natural gas vapor from the reaction vessel either by direct contact or by heat exchange means.

6. The method according to claim 1 wherein the dry pipeline natural gas has less than about one part per million water content.

7. The method according to claim 1 wherein the liquefied petroleum gas is comprised of butane.

8. The method according to claim 1 wherein the liquefied petroleum gas is comprised of an admixture of propane and butane.

9. The method according to claim 1 wherein vaporized liquefied natural gas from the mixing vessel is utilized to precool directly or indirectly the pipeline natural gas.

10. A method for producing a liquid fuel solution of methane and liquefied petroleum gas comprising:

(a) providing an accumulation of liquefied natural gas in an insulated vessel;

(b) providing a thermal and solvent sink for methane by directly mixing the liquefied petroleum gas into the liquefied natural gas in said insulated vessel;

(c) vaporizing part of the liquefied natural gas and cooling the liquefied petroleum gas;

(d) adding dried pipeline natural gas to dissolve in the cooled liquefied petroleum gas; and (e) producing a binary liquid fuel of about 45% to about 75% by volume methane and from about 55% to about 25% by volume liquefied natural gas at a temperature and pressure sufficient to maintain the solution in a liquid state.

11. A method for producing a liquid fuel solution of methane and liquefied petroleum gas comprising:

(a) providing an accumulation of liquefied natural gas in an insulated pressure vessel;

(b) providing a thermal and solvent sink for methane by directly mixing the liquefied petroleum gas into the liquefied natural gas in said insulated pressure vessel;

(c) vaporizing part of the liquefied natural gas and cooling the liquefied petroleum gas;

(d) transporting the insulated pressure vessel containing the liquid fuel mixture to a source of natural gas;

(e) adding dried natural gas to dissolve in the liquid fuel mixture; and (f) producing a binary liquid fuel of about 45% to about 75% by volume methane and from about 55% to about 25% by volume liquid natural gas at a temperature and pressure sufficient to maintain the solution in a liquid state.

12. The method according to claim 11 wherein the binary liquid fuel solution is comprised of about 30% by volume liquefied petroleum gas and 70% by volume methane, the methane content being predominantly from dried pipeline natural gas and the remainder from liquefied natural gas which is present in the vessel before introduction of liquefied petroleum gas and pipeline natural gas.

13. The method according to claim 11 wherein the liquefied petroleum gas is propane and the binary liquid fuel temperature is from about −80° C. to about −120° C. at a pressure of about 230 to 300 psig.

14. The method according to claim 13 wherein the resulting binary liquid fuel solution of methane and propane is comprised of about 30% by volume propane and the methane content is derived from about 20% by volume from liquefied natural gas and about 50% by volume from dried pipeline natural gas.

15. The method according to claim 11 wherein the liquefied petroleum gas is comprised of butane.

16. The method according to claim 11 wherein the dry pipeline natural gas has less than about one part per million water content.

17. The method according to claim 11 wherein the liquefied petroleum gas is comprised of an admixture of propane and butane.

18. The method according to claim 11 wherein vaporized liquefied natural gas from the mixing vessel is utilized to precool directly or indirectly the pipeline natural gas.

19. A method for producing a liquid fuel solution of methane and liquefied petroleum gas comprising:

providing a thermal and solvent sink for methane by transporting a liquefied natural gas vessel containing liquefied natural gas to a source of liquefied petroleum gas and well head or pipeline natural gas;

directly mixing the liquefied petroleum gas into the liquefied natural gas in the vessel;

vaporizing part of the liquefied natural gas and cooling the liquefied petroleum gas;

adding natural gas to dissolve in the cooled liquefied petroleum gas; and producing a binary liquid fuel of about 45% to about 75% by volume methane and from about 55% to about 25% by volume liquefied petroleum gas at a temperature and pressure sufficient to maintain the solution in a liquid state.

* * * * *